US009171665B2

(12) United States Patent
Silva et al.

(10) Patent No.: US 9,171,665 B2
(45) Date of Patent: Oct. 27, 2015

(54) INTEGRATED INDUCTOR ASSEMBLIES AND METHODS OF ASSEMBLING SAME

(71) Applicant: General Electric Company, Schenectady, NY (US)

(72) Inventors: Arturo Silva, Allen, TX (US); John Steel, Plano, TX (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/196,779

(22) Filed: Mar. 4, 2014

(65) Prior Publication Data

US 2014/0266552 A1 Sep. 18, 2014

Related U.S. Application Data

(60) Provisional application No. 61/782,961, filed on Mar. 14, 2013.

(51) Int. Cl.

| | |
|---|---|
| ***H01F 17/04*** | (2006.01) |
| ***H01F 27/24*** | (2006.01) |
| ***H01F 27/28*** | (2006.01) |
| ***H01F 27/02*** | (2006.01) |
| ***H01F 7/06*** | (2006.01) |
| ***H01F 27/30*** | (2006.01) |

(52) U.S. Cl.

CPC ..... *H01F 27/306* (2013.01); *H01F 27/2847* (2013.01); *Y10T 29/49073* (2015.01)

(58) Field of Classification Search

CPC ..... H01F 17/043; H01F 27/006; H01F 27/26; H01F 27/263; H01F 27/28; H01F 27/303; H01F 41/02; H01F 21/00; H01F 27/306; H01F 27/2847; Y10T 29/49072

USPC ..... 336/212, 205, 220, 221, 199, 145–147; 29/606

See application file for complete search history.

(56) References Cited

U.S. PATENT DOCUMENTS

| | | | |
|---|---|---|---|
| 4,713,742 | A | 12/1987 | Parsley |
| 5,932,995 | A | 8/1999 | Wagoner |
| 6,147,886 | A | 11/2000 | Wittenbreder |
| 6,756,875 | B2 | 6/2004 | Ahn et al. |

(Continued)

OTHER PUBLICATIONS

Falin, Jeff, Coupled inductors broaden DC/DC converter usage, Analog Applications Journal, 3Q 2010, pp. 10-12, Texas Instruments Incorporated, Dallas, TX.

(Continued)

*Primary Examiner* — Mangtin Lian
(74) *Attorney, Agent, or Firm* — General Electric Company

(57) ABSTRACT

An integrated inductor assembly is provided. The integrated inductor assembly includes a magnetic core, a first inductor, and a second inductor. The magnetic core has a first side, an opposing second side, and an opening defined within the magnetic core. The opening extends into the magnetic core from at least one of the first side and the second side. The first inductor includes a first conductive winding inductively coupled to the magnetic core. The first conductive winding includes a first shorting segment positioned within the opening. The second inductor includes a second conductive winding inductively coupled to the magnetic core. The second conductive winding includes a second shorting segment positioned within the opening. The first and second inductors are configurable to operate independently of one another.

20 Claims, 11 Drawing Sheets

(56) References Cited

U.S. PATENT DOCUMENTS

| | | | | |
|---|---|---|---|---|
| 8,324,871 | B2 | 12/2012 | Tsai et al. | |
| 2002/0118000 | A1 | 8/2002 | Xu et al. | |
| 2003/0052655 | A1 | 3/2003 | Harris et al. | |
| 2006/0145800 | A1* | 7/2006 | Dadafshar et al. | 336/82 |
| 2008/0224812 | A1 | 9/2008 | Chandrasekaran | |
| 2010/0039200 | A1* | 2/2010 | Yan et al. | 336/147 |
| 2012/0049994 | A1 | 3/2012 | Joo et al. | |
| 2012/0243279 | A1 | 9/2012 | Zacharias et al. | |
| 2012/0262265 | A1* | 10/2012 | Lo et al. | 336/83 |

OTHER PUBLICATIONS

Gallagher, John, Coupled Inductors Improve Multiphase Buck Efficiency, Power Electronics Technology, Jan. 2006, pp. 36-42.

* cited by examiner

INTEGRATED INDUCTOR ASSEMBLIES AND METHODS OF ASSEMBLING SAME

CROSS-REFERENCE TO RELATED APPLICATIONS

This application claims the benefit of U.S. Provisional Patent Application No. 61/782,961 filed Mar. 14, 2013, which is hereby incorporated by reference in its entirety.

BACKGROUND

The field of the embodiments relate generally to power electronics, and more particularly, to integrated inductor assemblies for use in power electronics.

High density power electronic circuits often require the use of multiple magnetic electrical components for a variety of purposes, including energy storage, signal isolation, signal filtering, energy transfer, and power splitting. As the demand for higher power density electrical components increases, it becomes more desirable to integrate two or more magnetic electrical components, such as multiple inductors, into the same core or structure.

However, known integrated magnetic assemblies are often not adequately configured to permit multiple windings to be manufactured on a single structure and to operate independently of one another. As a result, separate cores or structures are used when multiple components are operated independently in a given electronics circuit, thereby increasing the number and size of the components needed for a given operation, and reducing the power density of a given electronics circuit.

BRIEF DESCRIPTION

In one aspect, an integrated inductor assembly is provided. The integrated inductor assembly includes a magnetic core, a first inductor, and a second inductor. The magnetic core has a first side, an opposing second side, and an opening defined within the magnetic core. The opening extends into the magnetic core from at least one of the first side and the second side. The first inductor includes a first conductive winding inductively coupled to the magnetic core. The first conductive winding includes a first shorting segment positioned within the opening. The second inductor includes a second conductive winding inductively coupled to the magnetic core. The second conductive winding includes a second shorting segment positioned within the opening. The first and second inductors are configurable to operate independently of one another.

In another aspect, a method of assembling an integrated inductor assembly is provided. The method includes providing a magnetic core having a first side, an opposing second side, and an opening defined within the magnetic core, the opening extending into the magnetic core from at least one of the first side and the second side, providing a first conductive winding including a first shorting segment, providing a second conductive winding including a second shorting segment, inductively coupling the first conductive winding to the magnetic core to form a first inductor, the first conductive winding coupled such that the first shorting segment is positioned within the opening, and inductively coupling the second conductive winding to the magnetic core to form a second inductor, the second conductive winding coupled such that the second shorting segment is positioned within the opening, and the first and second conductive windings inductively coupled to the magnetic core such that the first and second inductors are configurable to operate independently of one another.

In yet another aspect, a magnetic core for use in an integrated inductor assembly is provided. The magnetic core includes a first piece defining a first side of the magnetic core, a second piece defining a second side of the magnetic core opposite the first side, and an opening defined within the magnetic core. The second piece is formed separately from and attached to the first piece. At least one of the first piece and the second piece have a plurality of channels defined therein. Each of the channels is configured to receive a conductive winding to form an inductor. The opening extends into the magnetic core from at least one of the first side and the second side. Each of the channels extends into the opening, and is enclosed within the magnetic core between the first piece and the second piece.

Although specific features of various embodiments may be shown in some drawings and not in others, this is for convenience only. Any feature of any drawing may be referenced and/or claimed in combination with any feature of any other drawing.

DETAILED DESCRIPTION

Exemplary embodiments of integrated inductor assemblies are described herein. An integrated inductor assembly includes a magnetic core, a first inductor, and a second inductor. The magnetic core has a first side, an opposing second side, and an opening defined within the magnetic core. The opening extends into the magnetic core from at least one of the first side and the second side. The first inductor includes a first conductive winding inductively coupled to the magnetic core. The first conductive winding includes a first shorting segment positioned within the opening. The second inductor includes a second conductive winding inductively coupled to the magnetic core. The second conductive winding includes a second shorting segment positioned within the opening. The first and second inductors are configurable to operate independently of one another.

The embodiments described herein provide an integrated inductor assembly that includes at least two inductors capable of operating jointly and independently of one another. The integrated inductor assembly includes a magnetic core having an opening defined therein and a winding assembly inductively coupled to the magnetic core. Inductive segments of the winding assembly are enclosed within the magnetic assembly, and shorting segments that interconnect the inductive segments are positioned within the opening of the magnetic core. Such a configuration reduces and/or minimizes the mutual inductance between multiple inductors formed on the magnetic core, thus enabling the inductors to be operated independently of one another. Further, the integration of multiple inductors on a single magnetic core facilitates reducing the number and size of components needed to construct a given type of electrical circuit (e.g., a power converter).

Figure 1:
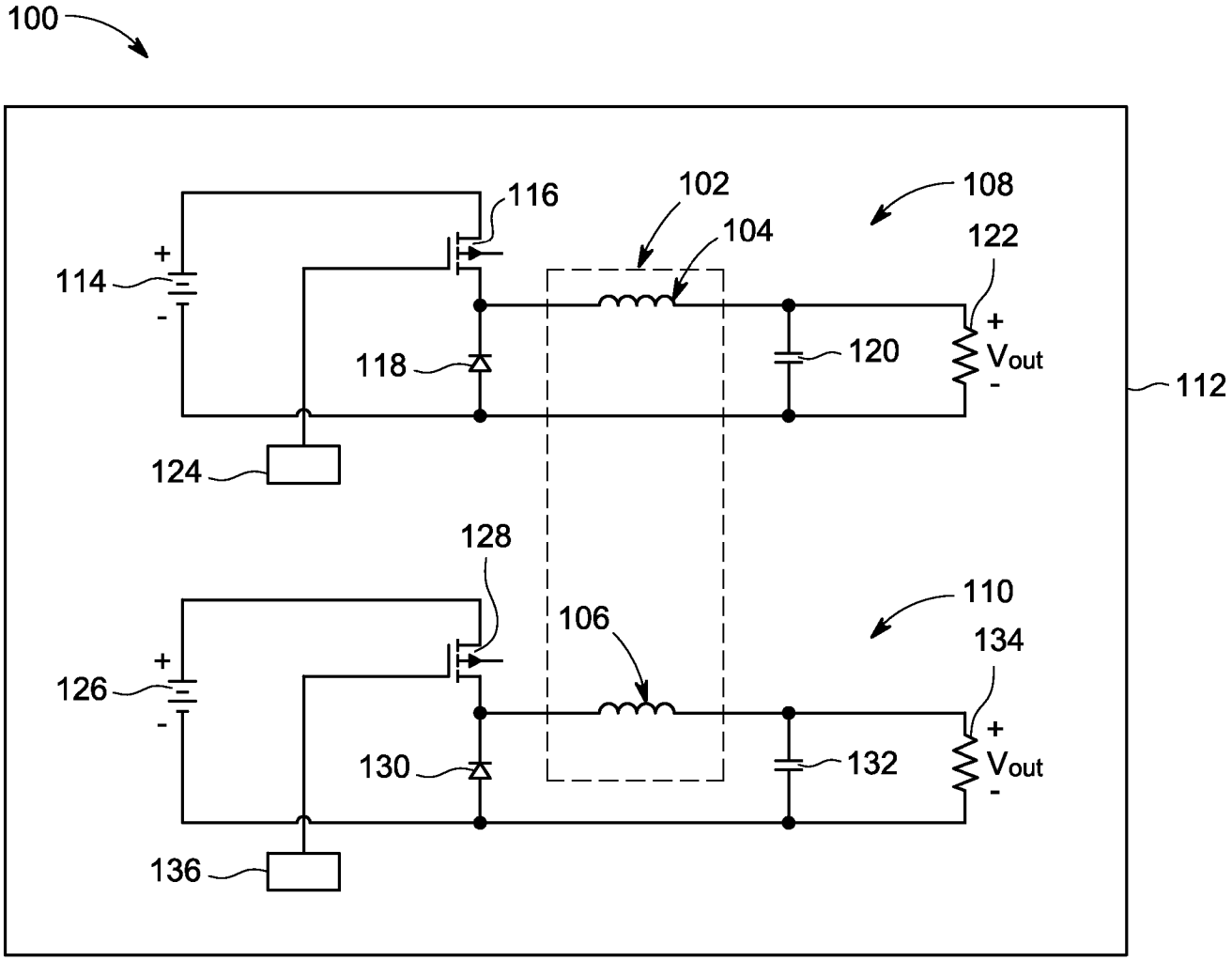
FIG. 1 is a schematic view of an example electronics system that includes an integrated inductor assembly.

FIG. 1 is a schematic view of an example electronics system 100 that includes an integrated inductor assembly 102 including a first inductor 104 and a second inductor 106. Electronics system 100 also includes a first electrical circuit 108 and a second electrical circuit 110 fabricated on a printed circuit board 112.

In the example embodiment, first electrical circuit 108 and second electrical circuit 110 are each buck switching DC-DC voltage converters. Specifically, first electrical circuit 108 includes a first DC voltage supply 114, a first switching device 116, a first diode 118, first inductor 104, a first capacitor 120, a first load 122, and a first controller 124. The positive terminal of first DC voltage supply 114 is coupled to first switching device 116, which is in turn coupled to the cathode end of first diode 118 and first inductor 104. The anode end of first diode 118 is coupled to the return input terminal of first DC voltage supply 114. First capacitor 120 and first load 122 are coupled in parallel, and first inductor 104 is coupled to the first side of the parallel connection between first capacitor 120 and first load 122. First switching device 116 is operated by first controller 124, which switches first switching device 116 between open and closed positions to produce an output voltage $V_{out}$ of first electrical circuit 108, which is measured as the voltage drop across first load 122.

In the example embodiment, second electrical circuit 110 has an identical architecture to first electrical circuit 108. Specifically, second electrical circuit 110 includes a second DC voltage supply 126, a second switching device 128, a second diode 130, second inductor 106, a second capacitor 132, a second load 134, and a second controller 136. The positive terminal of second DC voltage supply 126 is coupled to second switching device 128, which is in turn coupled to the cathode end of second diode 130 and second inductor 106. The anode end of second diode 130 is coupled to the return input terminal of second DC voltage supply 126. Second capacitor 132 and second load 134 are coupled in parallel, and second inductor 106 is coupled to one side of the parallel connection between second capacitor 132 and second load 134. Second switching device 128 is operated by second controller 136, which switches second switching device 128 between open and closed positions to produce an output voltage $V_{out}$ of second electrical circuit 110, which is measured as the voltage drop across second load 134.

In the example embodiment, first switching device 116 and second switching device 128 are transistor switches (specifically, MOSFETs), and first controller 124 and second controller 136 are configured to output a pulse-width modulated control signal to the gate side of first switching device 116 and second switching device 128, respectively. In alternative embodiments, first switching device 116 and/or second switching device 128 may be any suitable switching device that enables electronics system 100 to function as described herein. Further, first controller 124 and/or second controller 136 may be configured to supply any suitable control signal to first switching device 116 and second switching device 128, respectively, that enables electronics system 100 to function as described herein.

As described herein in more detail, the construction of integrated inductor assembly 102 enables first inductor 104 and second inductor 106 to operate independently of one another as well as jointly with one another (e.g., as part of the same circuit). Thus, while integrated inductor assembly 102 is described with reference to separate buck switching DC-DC voltage converters (i.e., first electrical circuit 108 and second electrical circuit 110), the embodiments described herein may be implemented in any suitable electrical architecture that enables integrated inductor assembly 102 to function as described herein including, for example, a multi-phase voltage converter in which first inductor 104 is operated out of phase from second inductor 106 by a phase difference of about 90° or 180°.

Figure 2:
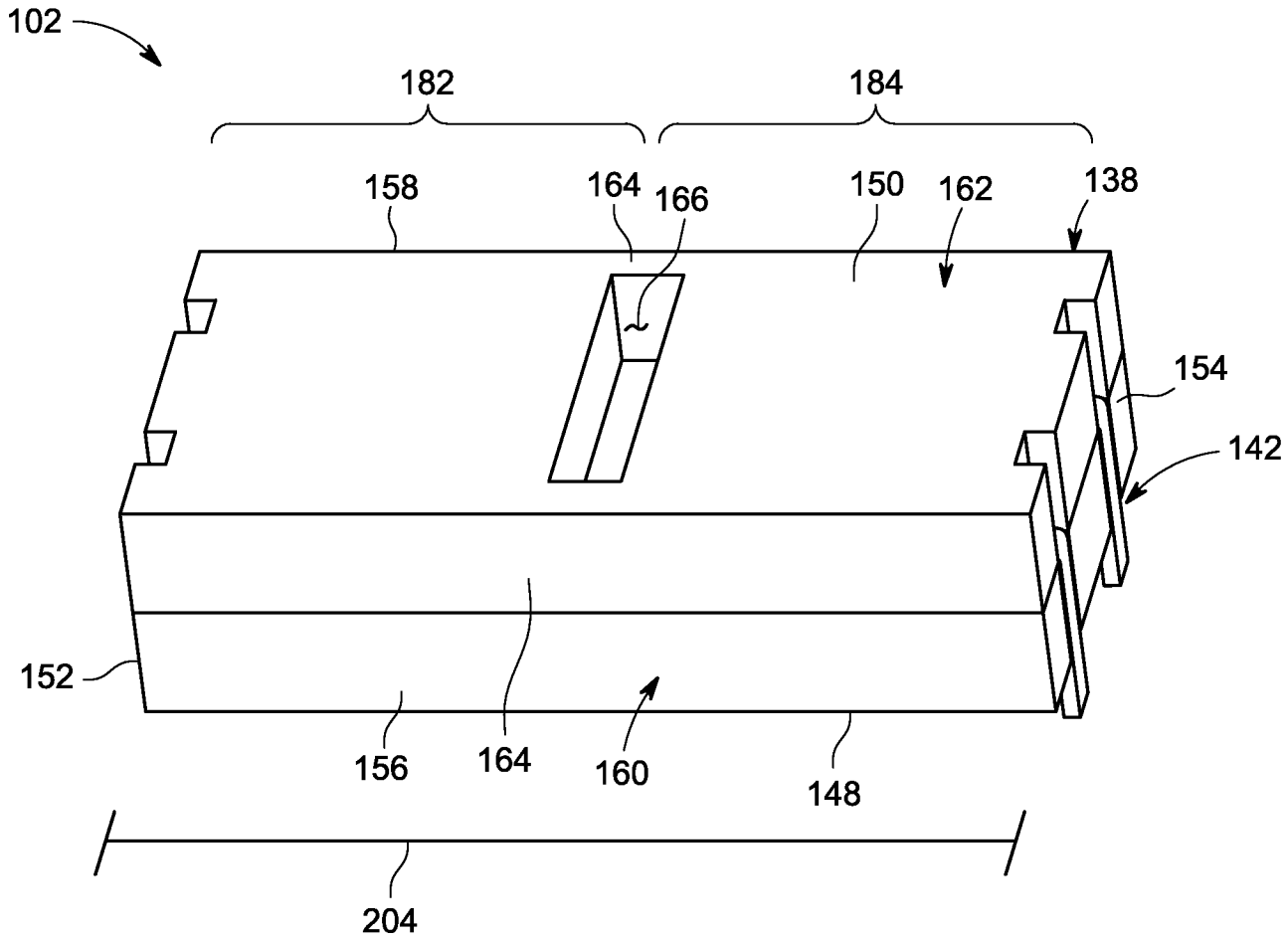
FIG. 2 is a perspective view of the integrated inductor assembly shown in FIG. 1 that includes a magnetic core and a winding assembly.
Figure 3:
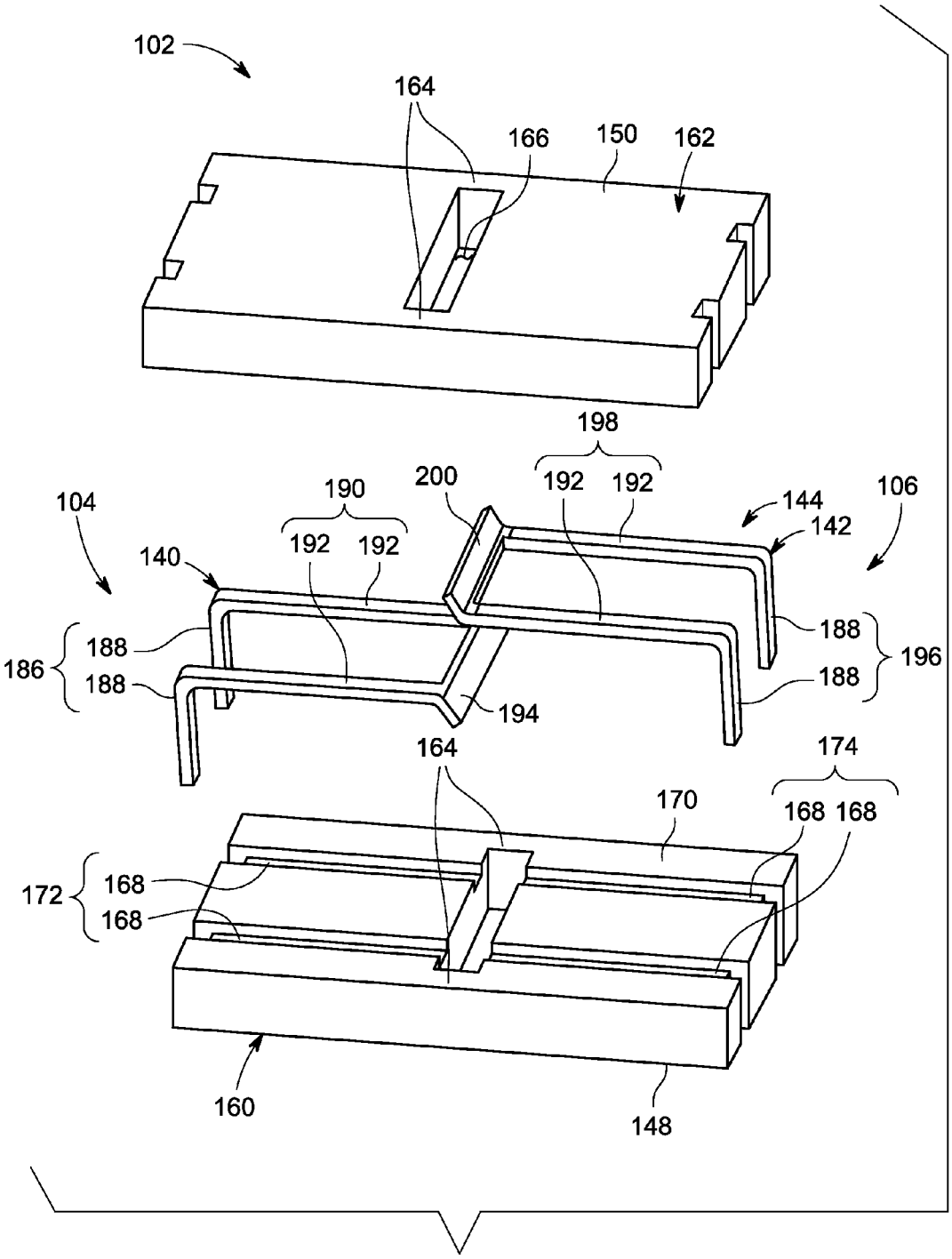
FIG. 3 is an exploded view of the integrated inductor assembly shown in FIG. 2.

FIG. 2 is a perspective view of integrated inductor assembly 102, and FIG. 3 is an exploded view of integrated inductor assembly 102. In the example embodiment, integrated inductor assembly 102 includes a magnetic core 138, a first conductive winding 140 (FIG. 3) inductively coupled to magnetic core 138 to form first inductor 104, and a second conductive winding 142 inductively coupled to magnetic core 138 to form second inductor 106. First conductive winding 140 and second conductive winding 142 are collectively referred to herein as a winding assembly, indicated generally at 144. In the example embodiment, winding assembly 144 also includes a molding compound 146 (FIGS. 8-10), which is omitted from FIGS. 2 and 3 for clarity.

In the example embodiment, magnetic core 138 has a generally rectangular shape including a first side 148, an opposing second side 150, first and second opposing ends 152 and 154 extending between first side 148 and second side 150, and a front side 156 and an opposing rear side 158 extending between first side 148 and second side 150 and between first end 152 and second end 154. Further, in the example embodiment, magnetic core 138 includes a first piece 160, a second piece 162, a plurality of core bridges 164, and an opening 166 defined within magnetic core 138.

Figure 4:
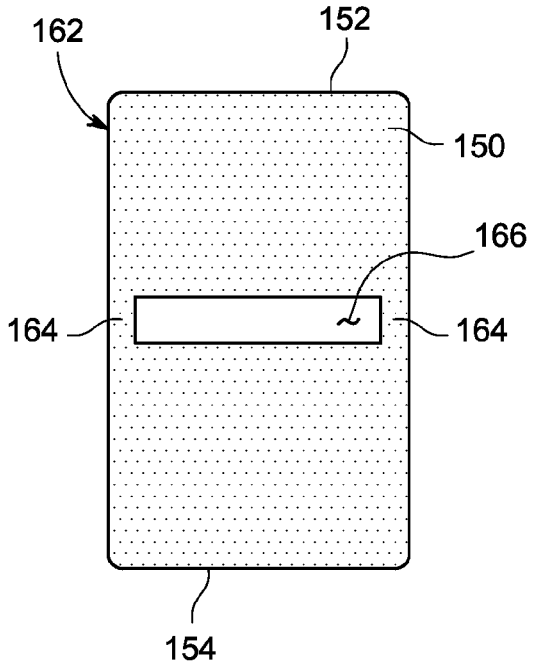
FIG. 4 is a top view of a piece of the magnetic core shown in FIG. 2.
Figure 6:
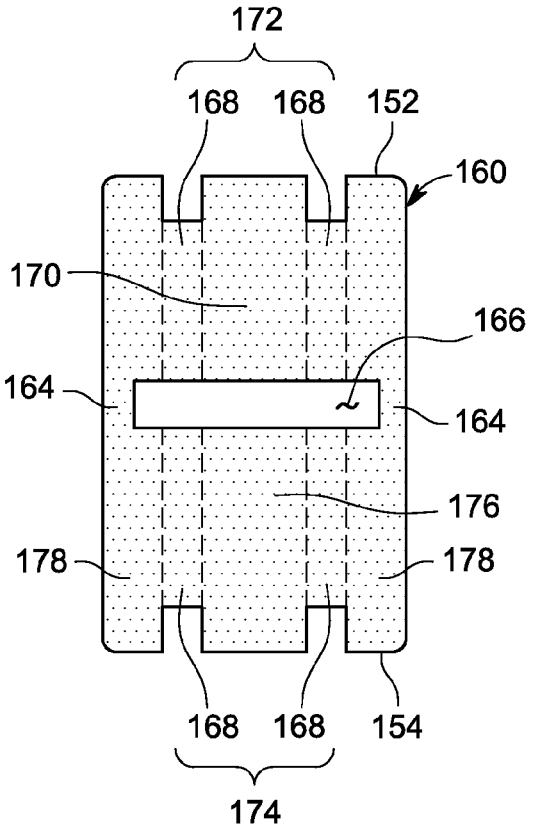
FIG. 6 is a top view another piece of the magnetic core shown in FIG. 2.
Figure 5:
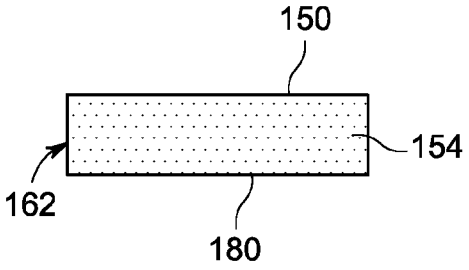
FIG. 5 is an end view of the piece of the magnetic core shown in FIG. 4.
Figure 7:
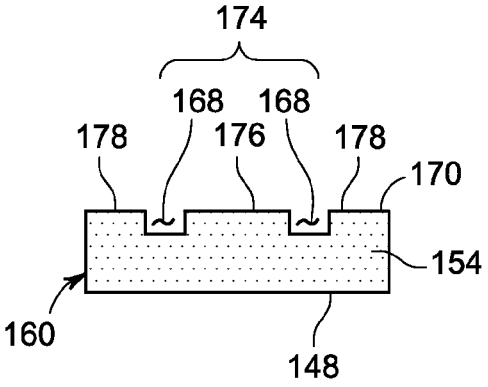
FIG. 7 is an end view of the piece of the magnetic core shown in FIG. 6.

FIG. 4 is a top view of second piece 162 of magnetic core 138, and FIG. 5 is an end view of second piece 162 of magnetic core 138. FIG. 6 is a top view of first piece 160 of magnetic core 138, and FIG. 7 is an end view of first piece 160 of magnetic core 138. In the example embodiment, first piece 160 and second piece 162 are each fabricated as unitary magnetic blocks. First piece 160 and second piece 162 are fabricated from any suitable magnetic material that enables integrated inductor assembly 102 to function as described herein including, for example, ferrite. Further, first piece 160 and second piece 162 are fabricated from the same magnetic material. First piece 160 and second piece 162 are fabricated separately and attached to one another to form magnetic core 138. In alternative embodiments, first piece 160 and/or second piece 162 may be fabricated other than as a unitary magnetic block (see, e.g., FIGS. 16 and 17).

In the example embodiment, first piece 160 defines first side 148 of magnetic core 138 and second piece 162 defines opposing second side 150 of magnetic core 138. Further, first piece 160 and second piece 162 collectively define first end 152, second end 154, front side 156 and rear side 158 of magnetic core 138.

Further, in the example embodiment, first piece 160 includes a plurality of channels 168 defined therein. Channels 168 are configured to receive a portion of conductive windings 140 and 142 to form one of first inductor 104 and second inductor 106. Specifically, channels 168 are defined on an interior surface 170 of first piece 160, and each channel 168 extends from opening 166 towards one of first end 152 and second end 154. Further, in the example embodiment, channels 168 extend around a respective first end 152 or second end 154 to first side 148 of magnetic core 138 such that conductive windings 140 and 142 are flush with a respective first end 152 or second end 154 when integrated inductor assembly 102 is assembled. Further, when integrated inductor assembly 102 is assembled, channels 168 are enclosed within magnetic core 138 between first side 148 and second side 150, more specifically, between first piece 160 and second piece 162.

As shown in FIG. 3, the plurality of channels 168 includes a first pair 172 of channels 168 and a second pair 174 of channels 168. First pair 172 of channels 168 extends from opening 166 towards first end 152 of magnetic core 138, and second pair 174 of channels 168 extends from opening 166 towards second end 154 of magnetic core 138. Channels 168 of first pair 172 of channels 168 are substantially parallel to one another, and channels 168 of second pair 174 of channels 168 are substantially parallel to one another. As shown in FIG. 6, each pair 172 and 174 of channels 168 divides interior surface 170 into a central region 176 and lateral outer regions 178.

Second piece 162 includes an interior surface 180 facing interior surface 170 of first piece 160 when integrated inductor assembly 102 is assembled. In the example embodiment, interior surface 180 of second piece 162 is substantially planar, and does not include any channels therein. In alternative embodiments, interior surface 180 of second piece 162 may include channels corresponding to channels 168 of first piece 160. In yet further alternative embodiments, interior surface 170 of first piece may be substantially planar (i.e. first piece 160 does not include channels 168), and channels 168 are defined within interior surface 180 of second piece 162.

Referring to FIG. 2, opening 166 divides magnetic core 138 into a first inductive section 182 and a second inductive section 184. First inductive section 182 extends from opening 166 to first end 152 of magnetic core 138, and includes first pair 172 of channels 168. Second inductive section 184 extends from opening 166 to second end 154 of magnetic core 138, and includes second pair 174 of channels 168. Opening 166 is configured to limit the magnetic flux from one of first inductor 104 and second inductor 106 from interfering with or affecting the operation of the other of first inductor 104 or second inductor 106.

In the example embodiment, opening 166 has a generally rectangular shape, and extends through magnetic core 138 from first side 148 to second side 150. That is, opening 166 extends through both first piece 160 and second piece 162. In alternative embodiments, opening 166 may have any suitable shape that enables integrated inductor assembly 102 to function as described herein. Further, in alternative embodiments, opening 166 can extend into magnetic core 138 from only one of first side 148 or second side 150. That is, opening 166 may not extend completely through magnetic core 138. In some suitable embodiments, opening 166 in magnetic core 138 is filled with one or more non-magnetic materials to prevent foreign objects from entering opening and interfering with the operation of integrated inductor assembly 102.

Core bridges 164 extend between and interconnect first inductive section 182 and second inductive section 184. Further, the plurality of core bridges 164 at least partially define opening 166. In the example embodiment, first piece 160 includes two core bridges 164 disposed on opposite sides of opening 166, and second piece 162 includes two core bridges 164 disposed on opposite sides of opening 166.

In the example embodiment, core bridges 164 are configured to provide a low reluctance magnetic flux path between first inductive section 182 and second inductive section 184 such that first inductor 104 and second inductor 106 can "share" magnetic core 138 when one of first inductive section 182 and second inductive section 184 is not saturated by operation of a respective first inductor 104 or second inductor 106. In the example embodiment, each core bridge 164 is fabricated from a suitable magnetic material, such as ferrite. Further, in the example embodiment, core bridges 164 are integrally formed with one of first piece 160 or second piece 162 of magnetic core 138, although in alternative embodiments, one or more core bridges 164 may be formed separately from first piece 160 and/or second piece 162. The "sharing" of magnetic core 138 between first inductor 104 and second inductor 106 increases the saturation current of first inductor 104 and second inductor 106 (i.e., the current at which magnetic core 138 is saturated) when one of first inductor 104 and second inductor 106 are operated at low loads or low currents because core bridges 164 enable inductors 104 and 106 to utilize portions of magnetic core 138 that would otherwise be unsaturated by operation of one of first inductor 104 or second inductor 106 at low loads or low currents.

Figure 8:
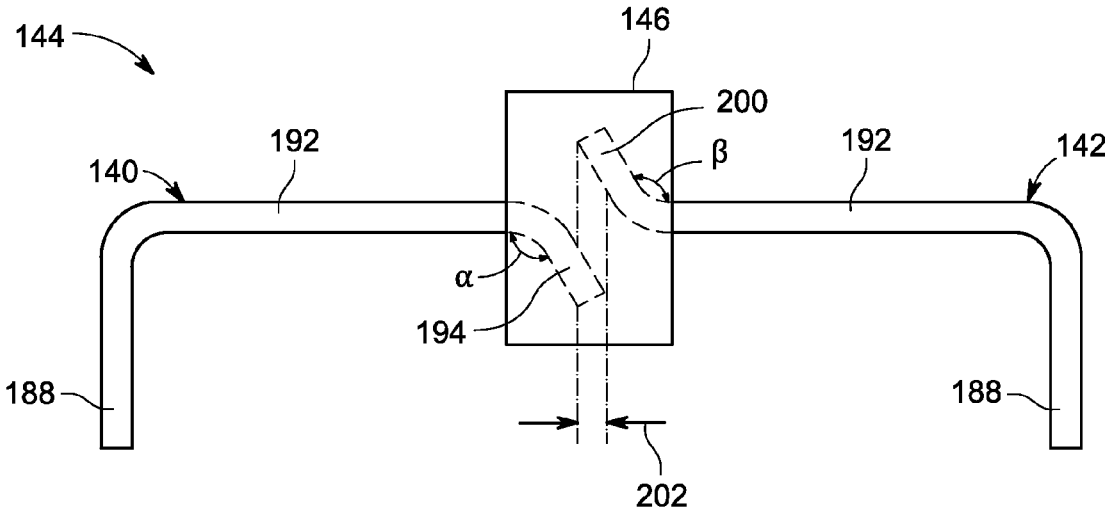
FIG. 8 is a side view of the winding assembly shown in FIGS. 2 and 3.
Figure 9:
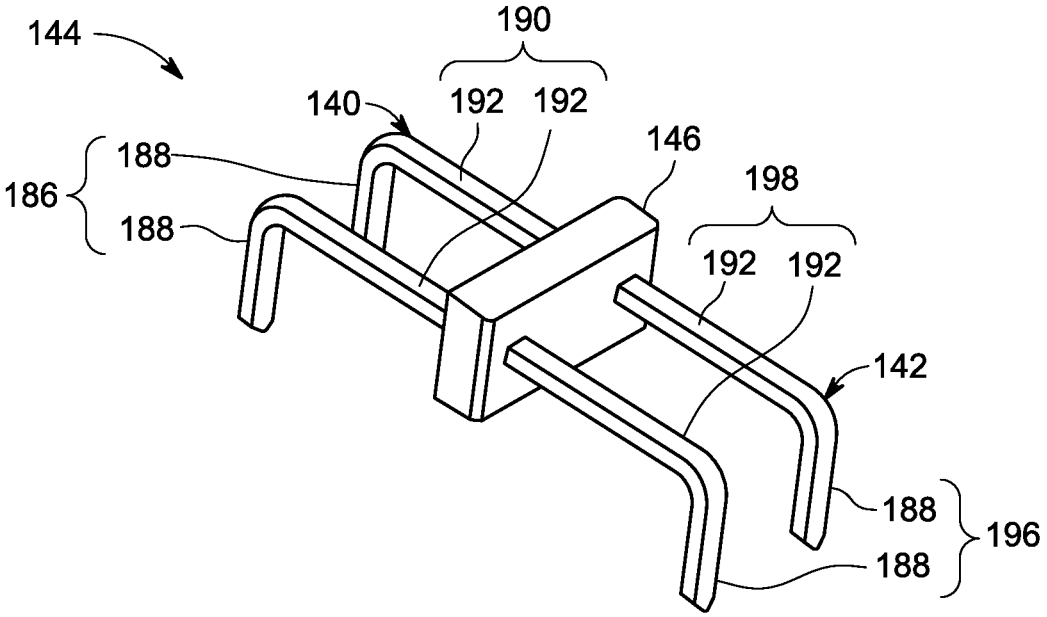
FIG. 9 is a perspective view of the winding assembly shown in FIG. 8.
Figure 10:
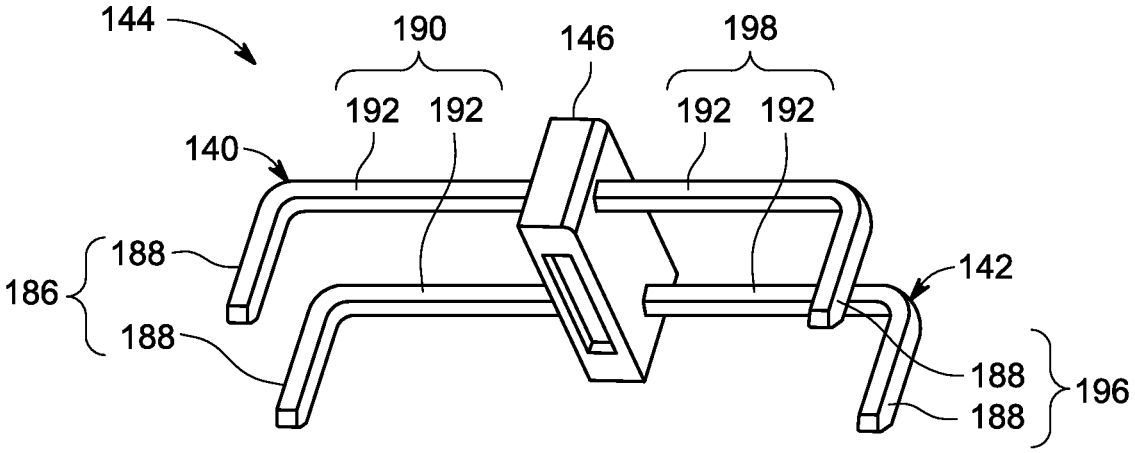
FIG. 10 is another perspective view of the winding assembly shown in FIG. 8.

As noted above, first inductor 104 includes first conductive winding 140 inductively coupled to magnetic core 138 and second inductor 106 includes second conductive winding 142 inductively coupled to magnetic core 138. FIG. 8 is a side view of winding assembly 144 including first conductive winding 140, second conductive winding 142, and molding compound 146. FIGS. 9 and 10 are perspective views of winding assembly 144.

Referring to FIGS. 3 and 8-10, first conductive winding 140 is fabricated from a suitable conductive material (e.g., stamped copper), and includes a first pair 186 of lead segments 188, a first pair 190 of inductive segments 192, and a first shorting segment 194 interconnecting first pair 190 of inductive segments 192.

Inductive segments 192 of first pair 190 of inductive segments 192 are positioned within first pair 172 of channels 168. Each inductive segment 192 of first pair 190 of inductive segments 192 extends from opening 166 towards first end 152 of magnetic core 138 to a corresponding lead segment 188 of first pair 186 of lead segments 188. Inductive segments 192 of first pair 190 of inductive segments 192 are enclosed within magnetic core 138 between first side 148 and second side 150, more specifically, between first piece 160 and second piece 162. Inductive segments 192 of first pair 190 of inductive segments 192 are disposed in a first plane.

First shorting segment 194 is positioned within opening 166, and extends between and interconnects inductive segments 192 of first pair 190 of inductive segments 192. In the example embodiment, first shorting segment 194 is oriented substantially perpendicular to each inductive segment 192 of first pair 190 of inductive segments 192. Further, in the example embodiment, first shorting segment 194 has a substantially planar configuration, and is obliquely angled with respect to the first plane in which first pair 190 of inductive segments 192 is disposed. Specifically, first shorting segment 194 is obliquely angled towards first side 148 of magnetic core 138. Further, in the example embodiment, first shorting segment 194 has a cross-sectional area greater than each inductive segment 192 of first pair 190 of inductive segments 192.

Each lead segment 188 of first pair 186 of lead segments 188 is connected to a respective inductive segment 192 of first pair 190 of inductive segments 192 at first end 152 of magnetic core 138. In the example embodiment, each lead segment 188 of first pair 186 of lead segments 188 extends at an angle of about 90° from a respective inductive segment 192 of first pair 190 of inductive segments 192 towards first side 148 of magnetic core 138. Further, in the example embodiment, each lead segment 188 of first pair 186 of lead segments 188 extends beyond first side 148 of magnetic core 138 such that first pair 186 of lead segments 188 spaces magnetic core 138 from a surface on which integrated inductor assembly 102 is soldered or mounted (e.g., a printed circuit board).

In the example embodiment, second conductive winding 142 has a substantially similar configuration to first conductive winding 140. Specifically, second conductive winding 142 is fabricated from a suitable conductive material (e.g., stamped copper), and includes a second pair 196 of lead segments 188, a second pair 198 of inductive segments 192, and a second shorting segment 200 interconnecting second pair 198 of inductive segments 192.

Inductive segments 192 of second pair 198 of inductive segments 192 are positioned within second pair 174 of channels 168. Each inductive segment 192 of second pair 198 of inductive segments 192 extends from opening 166 towards second end 154 of magnetic core 138 to a corresponding lead segment 188 of second pair 196 of lead segments 188. Inductive segments 192 of second pair 198 of inductive segments 192 are enclosed within magnetic core 138 between first side 148 and second side 150, more specifically, between first piece 160 and second piece 162. Inductive segments 192 of second pair 198 of inductive segments 192 are disposed in a second plane, which, in the example embodiment, is parallel to the first plane in which first pair 190 of inductive segments 192 is disposed. Further, in the example embodiment, the second plane is the same plane as the first plane in which first pair 190 of inductive segments 192 is disposed. As such, first pair 190 of inductive segments 192 and second pair 198 of inductive segments 192 are disposed in substantially the same plane in the example embodiment.

Second shorting segment 200 is positioned within opening 166, and extends between and interconnects inductive segments 192 of second pair 198 of inductive segments 192. In the example embodiment, second shorting segment 200 is oriented substantially perpendicular to each inductive segment 192 of second pair 198 of inductive segments 192. Further, in the example embodiment, second shorting segment 200 has a substantially planar configuration, and is obliquely angled with respect to the second plane in which second pair 198 of inductive segments 192 is disposed. Specifically, second shorting segment 200 is obliquely angled towards second side 150 of magnetic core 138. Further, in the example embodiment, second shorting segment 200 has a cross-sectional area greater than each inductive segment 192 of second pair 198 of inductive segments 192. As shown in FIG. 8, first shorting segment 194 and second shorting segment 200 are angled away from one another at approximately the same angle. More specifically, first shorting segment 194 is angled towards first side 148 of magnetic core 138 at an angle $\alpha$ with respect to the first plane, and second shorting segment 200 is angled towards second side 150 of magnetic core 138 at an angle $\beta$ with respect to the second plane that is substantially equal to angle $\alpha$. Angles $\alpha$ and $\beta$ may be any suitable angle within the range of about 90° to about 180°. In the illustrated embodiment, angles $\alpha$ and $\beta$ are each about 120°. Further, as shown in FIG. 8, first shorting segment 194 and second shorting segment 200 overlap one another within opening 166 by a length 202 when viewed through opening 166, specifically along a viewing direction perpendicular to the first plane and/or the second plane.

Each lead segment 188 of second pair 196 of lead segments 188 is connected to a respective inductive segment 192 of second pair 198 of inductive segments 192 at second end 154 of magnetic core 138. Thus, first pair 186 of lead segments 188 and second pair 196 of lead segments 188 are disposed on opposite ends of magnetic core 138. In the example embodiment, first pair 186 of lead segments 188 is disposed on first end 152 of magnetic core 138 and second pair of lead segments 188 is disposed on second end 154 of magnetic core 138. Further, in the example embodiment, each lead segment 188 of second pair 196 of lead segments 188 extends at an angle of about 90° from a respective inductive segment 192 of second pair 198 of inductive segments 192 towards second side 150 of magnetic core 138. Further, in the example embodiment, each lead segment 188 of second pair 196 of lead segments 188 extends beyond second side 150 of magnetic core 138 such that second pair 196 of lead segments 188 spaces magnetic core 138 from a surface on which integrated inductor assembly 102 is soldered or mounted (e.g., a printed circuit board).

Referring to FIGS. 8-10, first shorting segment 194 and second shorting segment 200 are enclosed within molding compound 146. Molding compound 146 is configured to be received within opening 166. Molding compound 146 may be formed from any suitable molding compound including, for example, a phenolic resin molding compound. The magnetic permeability of molding compound 146 may be greater than or less than the magnetic permeability of air, depending on a desired magnetic permeability within opening 166. Molding compound 146 facilitates the assembly of integrated inductor assembly 102 by reducing the number of separate components that need to be assembled, and also by maintaining the relative positions of first shorting segment 194 and second shorting segment 200. In alternative embodiments, molding compound 146 may be omitted from winding assembly 144.

As a result of the configuration of first conductive winding 140 and second conductive winding 142, first inductor 104 and second inductor 106 are essentially single-turn inductors. In other words, first conductive winding 140 and second conductive winding 142 are wound around magnetic core 138 no more than a single turn. As a result, the DC resistances of first inductor 104 and second inductor 106 are reduced as compared to multiple-turn inductors. Further, the inductances of first inductor 104 and second inductor 106 can be comparable to known multiple-turn inductors due to the enclosure of inductive segments 192 within magnetic core 138.

Figure 11:
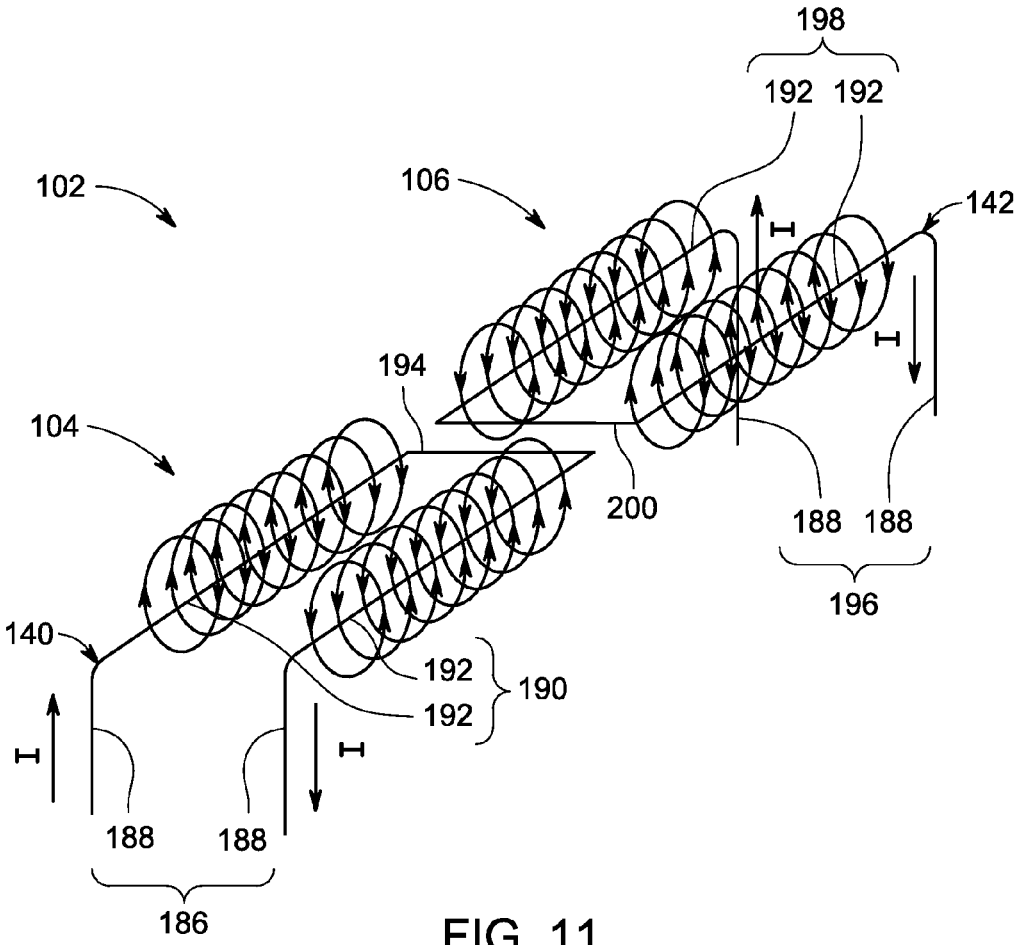
FIG. 11 is a schematic view of the integrated inductor assembly shown in FIGS. 2 and 3 illustrating the magnetic flux generated by operation of a first inductor and a second inductor of the integrated inductor assembly.
Figure 12:
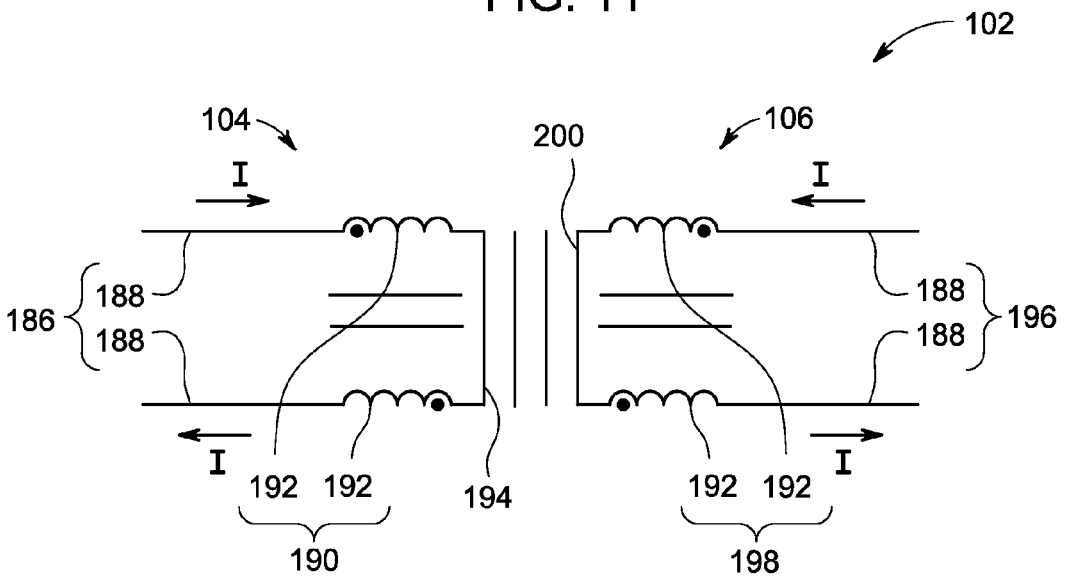
FIG. 12 is a schematic illustration of a circuit equivalent of the integrated inductor assembly shown in FIGS. 2 and 3.

FIG. 11 is a schematic view of integrated inductor assembly 102 illustrating the magnetic flux generated by operation of first inductor 104 and second inductor 106, and FIG. 12 is a schematic illustration of a circuit equivalent of integrated inductor assembly 102. The configuration of integrated inductor assembly 102 facilitates minimizing the mutual inductance (i.e., the inducement of an electromotive force in one inductor from the magnetic flux generated by a different inductor) between first inductor 104 and second inductor 106, thus enabling first inductor 104 and second inductor 106 to be operated independently of one another. Specifically, because inductive segments 192 are enclosed within magnetic core 138 having a relatively high magnetic permeability, and magnetic core 138 is divided into first inductive section 182 and second inductive section 184 by opening 166 having a relatively low magnetic permeability compared to magnetic core 138, the magnetic flux generated by first inductor 104 and second inductor 106 is substantially confined within first inductive section 182 and second inductive section 184, respectively. As a result, the magnetic flux within opening 166 is significantly less than the magnetic flux within magnetic core 138, and the mutual inductance between first inductor 104 and second inductor 106 is minimized. As shown in FIG. 12, the configuration of each of first inductor 104 and second inductor 106 is equivalent to two inductors (corresponding to inductive segments 192) connected in series by a respective shorting segment 194 or 200, which produces little to no magnetic flux within magnetic core 138.

Further, because first shorting segment 194 and second shorting segment 200 are angled away from one another, the first shorting segment 194 and the second shorting segment 200 can overlap one another within opening 166 while still maintaining a sufficient distance from one another to minimize mutual inductance between first inductor 104 and second inductor 106. Such an overlap reduces the overall length 204 (FIG. 2) of integrated inductor assembly 102 as compared to an integrated inductor assembly in which the shorting segments are not angled, and thus, require significantly more spacing along the length of the assembly to limit mutual inductance. Further, to the extent magnetic flux from one inductor 104 or 106 extends into the inductive section 182 or 184 of the other inductor 104 or 106, core bridges 164 provide a relatively low reluctance path for such magnetic flux, which minimizes the interference between the magnetic flux from first inductor 104 and second inductor 106.

Various modifications may be made to integrated inductor assembly 102 to further minimize or control the mutual inductance between first inductor 104 and second inductor 106, and/or to tune the performance of integrated inductor assembly 102.

Figure 13:
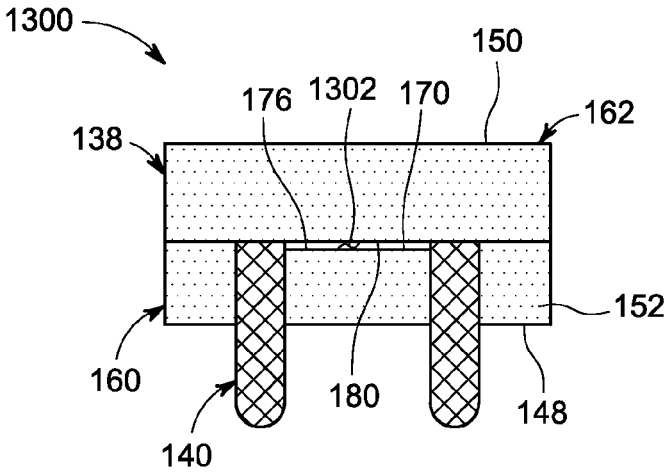
FIG. 13 is an end view of a first alternative integrated inductor assembly.

FIG. 13, for example, is an end view of a first alternative embodiment of an integrated inductor assembly 1300 having a gap 1302 disposed between first side 148 and second side 150 of magnetic core 138 to increase the saturation current of magnetic core 138. Unless specified, integrated inductor assembly 1300 is substantially identical to integrated inductor assembly 102 (shown in FIGS. 2 and 3). In the embodiment illustrated in FIG. 13, gap 1302 is positioned between central region 176 of interior surface 170 of first piece 160 and interior surface 180 of second piece 162, and extends the entire length of integrated inductor assembly 1300.

Figure 14:
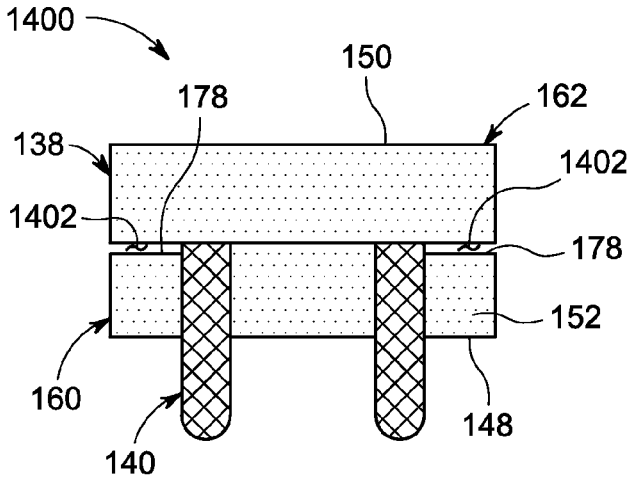
FIG. 14 is an end view of a second alternative integrated inductor assembly.

FIG. 14 is an end view of a second alternative embodiment of an integrated inductor assembly 102 having gaps 1402 disposed between first side 148 and second side 150 of magnetic core 138 to increase the saturation current of magnetic core 138. Unless specified, integrated inductor assembly 1400 is substantially identical to integrated inductor assembly 102 (shown in FIGS. 2 and 3). In the embodiment illustrated in FIG. 14, gaps 1402 are positioned between lateral outer regions 178 of interior surface 170 of first piece 160 and interior surface 180 of second piece 162, and extend the entire length of integrated inductor assembly 102.

Figure 15:
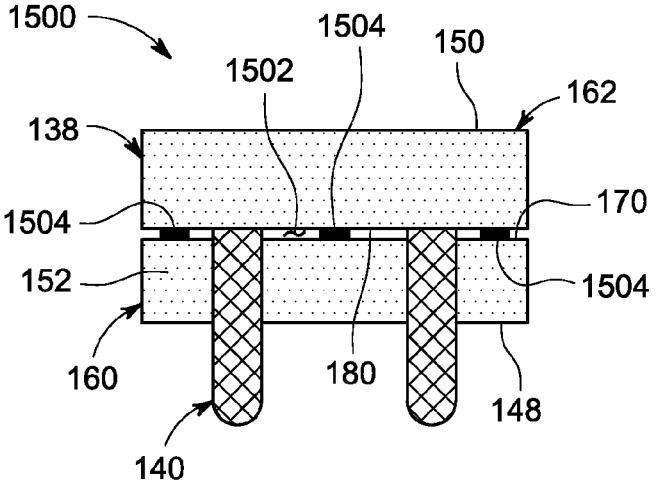
FIG. 15 is an end view of a third alternative integrated inductor assembly.

FIG. 15 is an end view of a third alternative embodiment of an integrated inductor assembly 1500 having a gap 1502 and a plurality of spacers 1504 disposed between first side 148 and second side 150 of magnetic core 138 to increase the saturation current of magnetic core 138. Unless specified, integrated inductor assembly 1500 is substantially identical to integrated inductor assembly 102 (shown in FIGS. 2 and 3). In the embodiment illustrated in FIG. 15, gap 1502 extends over the entirety of the interface between first piece 160 and second piece 162, and spacers 1504 are disposed at desired locations between first piece 160 and second piece 162 to provide a mechanical connection between first piece 160 and second piece 162. In the embodiment illustrated in FIG. 15, spacers 1504 are formed from a non-magnetic material.

In the embodiments illustrated in FIGS. 13-15, gaps 1302, 1402, and 1502 are void of any filler material and are thus air gaps. In alternative embodiments, gaps 1302, 1402, and/or 1502 may be filled with one or more non-magnetic materials including, for example, Mylar®, to adjust the characteristics of integrated inductor assemblies 1300, 1400, and/or 1500.

Figure 16:
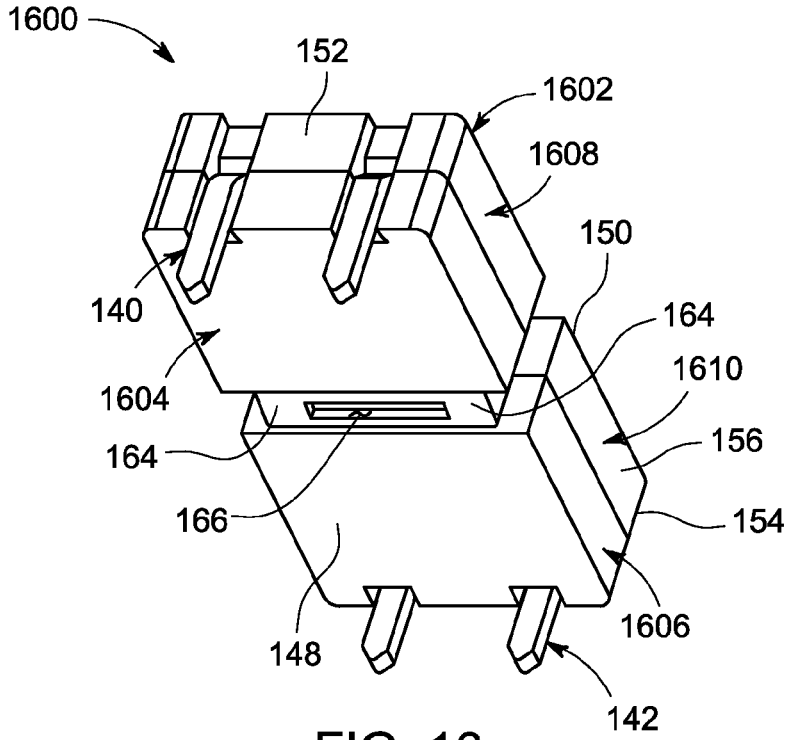
FIG. 16 is a perspective view of a fourth alternative integrated inductor assembly having a four-piece magnetic core.

FIG. 16 is a perspective view of a fourth alternative embodiment of an integrated inductor assembly 1600 having a four-piece magnetic core 1602. Unless specified, integrated inductor assembly 1600 is substantially identical to integrated inductor assembly 102 (shown in FIGS. 2 and 3). Magnetic core 1602 of integrated inductor assembly 1600 includes a first piece 1604, a second piece 1606, a third piece 1608, a fourth piece 1610, a plurality of core bridges 164, and an opening 166 defined within magnetic core 1602.

First piece 1604 and second piece 1606 are interconnected to one another by core bridges 164, and third piece 1608 and fourth piece 1610 are interconnected to one another by core bridges 164. Further, first piece 1604 and second piece 1606 collectively define first side 148 of magnetic core 1602, and third piece 1608 and fourth piece 1610 collectively define second side 150 of magnetic core 1602. Further, first piece 1604 and third piece 1608 collectively define first end 152 of magnetic core 1602, and second piece 1606 and fourth piece 1610 collectively define second end 154 of magnetic core 1602. First piece 1604, second piece 1606, third piece 1608 and fourth piece 1610 collectively define front side 156 and rear side 158 of magnetic core 1602.

First pair 172 of channels 168 (shown in FIG. 3) is defined on an interior surface of first piece 1604, and second pair 174 of channels 168 (shown in FIG. 3) is defined on an interior surface of second piece 1606. First pair 190 of inductive segments 192 (shown in FIG. 3) is positioned within first pair 172 of channels 168 on first piece 1604, and is enclosed within magnetic core 1602 between first side 148 and second side 150 of magnetic core 1602, specifically, between first piece 1604 and third piece 1608. Second pair 174 of channels 168 (shown in FIG. 3) is defined on an interior surface of second piece 1606. Second pair 198 of inductive segments 192 (shown in FIG. 3) is positioned within second pair 174 of channels 168, and is enclosed within magnetic core 1602 between first side 148 and second side 150 of magnetic core 1602, specifically, between second piece 1606 and fourth piece 1610.

In the embodiment illustrated in FIG. 16, core bridges 164 are fabricated separately from each of first piece 1604, second piece 1606, third piece 1608, and fourth piece 1610. Further, core bridges 164 are fabricated from a single piece of magnetic material and are connected to one another to provide improved mechanical stability to integrated inductor assembly 1600.

Figure 17:
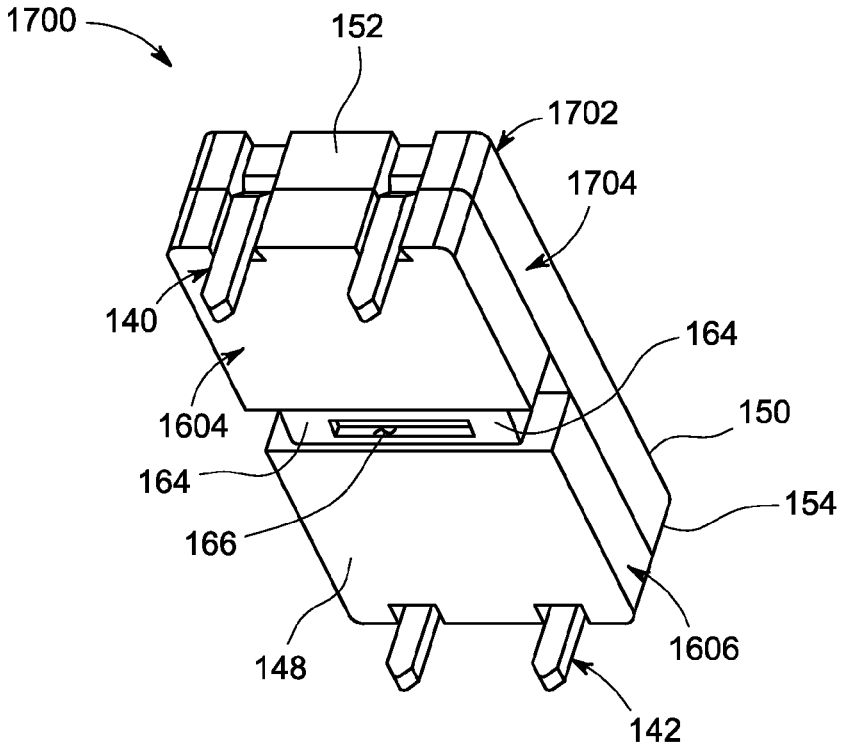
FIG. 17 is a perspective view of a fifth alternative integrated inductor assembly having a three-piece magnetic core.

FIG. 17 is a perspective view of a fifth alternative embodiment of an integrated inductor assembly 1700 having a three-piece magnetic core 1702. Unless specified, integrated inductor assembly 1700 is substantially identical to integrated inductor assembly 1600 (shown in FIG. 16). In particular, integrated inductor assembly 1700 is substantially identical to integrated inductor assembly 1600, except third piece 1608, fourth piece 1610, and core bridges 164 interconnecting third piece 1608 and fourth piece 1610 are replaced with a solid, unitary third piece 1704. Further, opening 166 in magnetic core 1702 only extends from first side 148 to third piece 1704. That is, opening 166 does not extend through the entirety of magnetic core 138.

Although integrated inductor assemblies 102, 1300, 1400, 1500, 1600, and 1700 are described as each including two inductors, integrated inductor assemblies 102, 1300, 1400, 1500, 1600, and 1700 can be modified to include more than two inductors, such as three, four, six, or more inductors.

Figure 18:
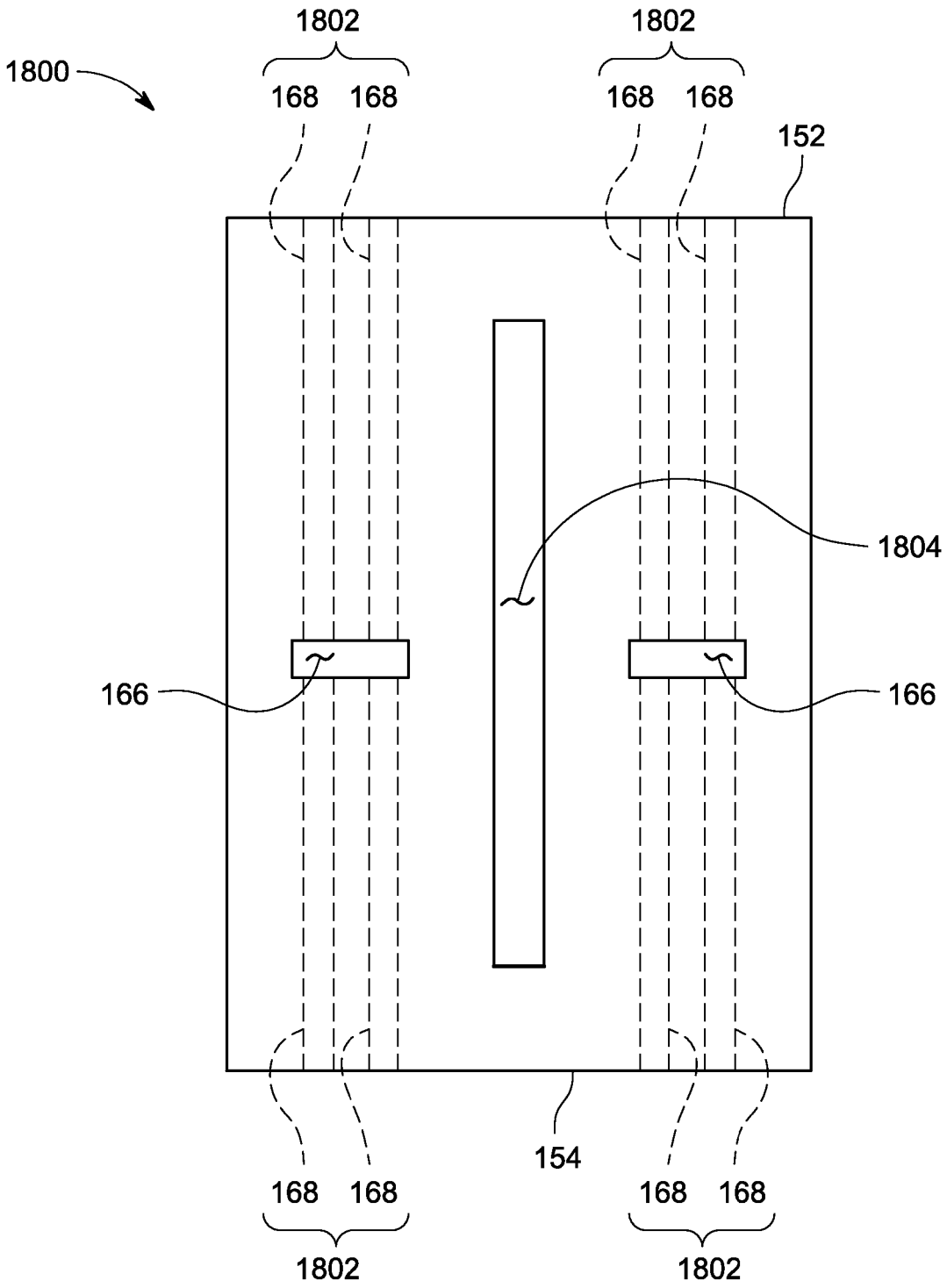
FIG. 18 is a top view of a first alternative magnetic core configured to receive four conductive windings to form a four-inductor integrated inductor assembly.

FIG. 18, for example, is a top view of a first alternative embodiment of a magnetic core 1800 configured to receive four conductive windings to form a four-inductor integrated inductor assembly. As shown in FIG. 18, magnetic core 1800 includes four pairs 1802 of channels 168 each configured to receive a conductive winding to form an inductor. Magnetic core 1800 also includes two openings 166, each opening 166 having two pairs 1802 of channels 168 extending from opening 166 towards one of first end 152 and second end 154 of magnetic core 138. Further, magnetic core 1800 includes an isolation opening 1804 positioned between openings 166. Isolation opening 1804 extends along a longitudinal direction of magnetic core 1800, and provides separation between inductor pairs formed on magnetic core 1800. In the illustrated embodiment, isolation opening 1804 extends through magnetic core 1800.

Figure 19:
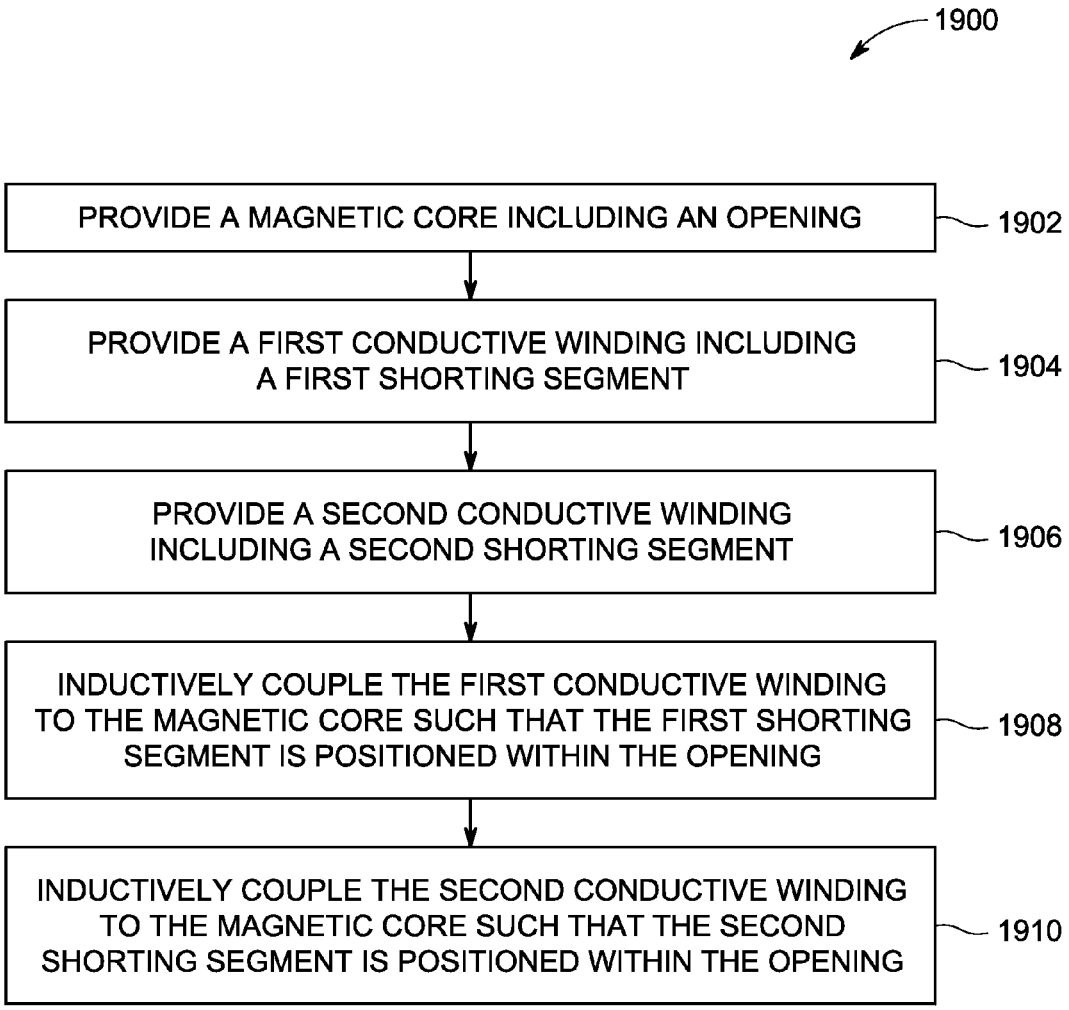
FIG. 19 is a flowchart of an exemplary method for assembling an integrated inductor assembly.

FIG. 19 is a flowchart of an exemplary method 1900 of assembling an integrated inductor assembly, such as integrated inductor assembly 102 shown in FIGS. 2 and 3. A magnetic core, such as magnetic core 138 is provided 1902. The magnetic core includes a first side, an opposing second side, and an opening defined within the magnetic core. The opening extends into the magnetic core from at least one of the first side and the second side. A first conductive winding, such as first conductive winding 140, is provided 1904. The first conductive winding includes a first shorting segment, such as first shorting segment 194. A second conductive winding, such as second conductive winding 142, is provided 1906. The second conductive winding includes a second shorting segment, such as second shorting segment 200. The first conductive winding is inductively coupled 1908 to the magnetic core to form a first inductor, such as first inductor 104. The first conductive winding is coupled to the magnetic core such that the first shorting segment is positioned within the opening. The second conductive winding is inductively coupled 1910 to the magnetic core to form a second inductor, such as second inductor 106. The second conductive winding is inductively coupled to the magnetic core such that the second shorting segment is positioned within the opening. Further, the first and second conductive windings are inductively coupled to the magnetic core such that the first and second inductors are configurable to operate independently of one another.

Exemplary embodiments of integrated inductor assemblies are described herein. An integrated inductor assembly includes a magnetic core, a first inductor, and a second inductor. The magnetic core has a first side, an opposing second side, and an opening defined within the magnetic core. The opening extends into the magnetic core from at least one of the first side and the second side. The first inductor includes a first conductive winding inductively coupled to the magnetic core. The first conductive winding includes a first shorting segment positioned within the opening. The second inductor includes a second conductive winding inductively coupled to the magnetic core. The second conductive winding includes a second shorting segment positioned within the opening. The first and second inductors are configurable to operate independently of one another.

As compared to at least some integrated magnetic assemblies, in the integrated inductor assemblies described herein, at least two inductors are formed on a single magnetic core, and the inductors are capable of operating jointly and independently of one another. Inductive segments of the winding assembly are enclosed within the magnetic assembly, and shorting segments that interconnect the inductive segments are positioned within the opening of the magnetic core. Such a configuration provides a compact integrated inductor assembly, yet sufficiently minimizes the mutual inductance between multiple inductors formed on the magnetic core to enable independent operation of the inductors. The compact configuration of integrated inductor assembly also decreases the number of components and board space needed to form a given electrical circuit as compared to the same electrical circuit formed using discrete components. Further, the configuration of integrated inductor assemblies reduces the DC resistance of the inductors formed therein as compared to multiple-turn inductors having similar inductances by utilizing shorter windings to form the inductors, and also by utilizing shorting segments having a greater cross-sectional area than the inductive segments of the winding.

Additionally, the integrated inductor assemblies described herein provide improved performance over discrete inductors when the inductors of the integrated inductor assembly are operated jointly with one another. In particular, when the inductors are operated jointly with one another (e.g., by operating the inductors out of phase from one another by a phase difference of about 180°), the energy losses of the integrated inductor assemblies are reduced as compared to discrete inductors used to perform equivalent functions due to flux cancellation within the magnetic core.

Additionally, the integrated inductor assemblies described herein utilize core bridges to provide a low reluctance flux path between different inductive sections of the magnetic core. The core bridges allow "sharing" of the different inductive sections of the magnetic core when one inductive section is not completely saturated. As a result, the saturation current of the inductors formed on the magnetic core can be increased as compared to discrete inductors.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An integrated inductor assembly comprising:

a magnetic core having a first side, an opposing second side, and an opening defined within said magnetic core, said opening extending into said magnetic core from at least one of said first side and said second side;

a first inductor comprising a first conductive winding inductively coupled to said magnetic core, said first conductive winding comprising a first pair of inductive segments and a first shorting segment interconnecting said first pair of inductive segments, wherein said first pair of inductive segments is disposed in a first plane and said first shorting segment is positioned within said opening; and a second inductor comprising a second conductive winding inductively coupled to said magnetic core, said second conductive winding comprising a second pair of inductive segments and a second shorting segment interconnecting said second pair of inductive segments, wherein said second pair of inductive segments is disposed in a second plane and said second shorting segment is positioned within said opening, said first and second shorting segments overlapping one another within said opening, wherein said opening extends into said magnetic core in a direction substantially perpendicular to at least one of the first plane and the second plane, and said first and second inductors are configurable to operate independently of one another.

2. An integrated inductor assembly in accordance with claim 1, wherein said opening extends through said magnetic core from said first side to said second side.

3. An integrated inductor assembly in accordance with claim 1, wherein said first pair of inductive segments and said second pair of inductive segments are enclosed within said magnetic core between said first and second sides.

4. An integrated inductor assembly in accordance with claim 1, wherein said first shorting segment is obliquely angled with respect to the first plane.

5. An integrated inductor assembly in accordance with claim 1, wherein said magnetic core has first and second opposing ends extending between said first side and said second side, said first conductive winding extending from said opening towards said first end, and said second conductive winding extending from said opening towards said second end.

6. An integrated inductor assembly in accordance with claim 1, further comprising a molding compound disposed within said opening, said first and second shorting segments enclosed within said molding compound.

7. An integrated inductor assembly in accordance with claim 1, wherein said magnetic core comprises a first piece and a second piece formed separately from and attached to said first piece, wherein said opening extends through said first piece and said second piece.

8. An integrated inductor assembly in accordance with claim 1, wherein said magnetic core includes a first section and a second section, said first conductive winding inductively coupled to said first section, said second conductive winding inductively coupled to said second section, said magnetic core further comprising a plurality of core bridges interconnecting said first section and said second section, the plurality of core bridges at least partially defining said opening.

9. A method of using the integrated inductor assembly of claim 1, said method comprising operating said first inductor independently of said second inductor.

10. A method of assembling an integrated inductor assembly, said method comprising:

providing a magnetic core having a first side, an opposing second side, and an opening defined within the magnetic core, the opening extending into the magnetic core in a first direction from at least one of the first side and the second side;

providing a first conductive winding including a first pair of inductive segments disposed in a first plane and a first shorting segment interconnecting the first pair of inductive segments;

providing a second conductive winding including a second pair of inductive segments disposed in a second plane and a second shorting segment interconnecting the second pair of inductive segments;

inductively coupling the first conductive winding to the magnetic core to form a first inductor, wherein the first conductive winding is coupled such that the first shorting segment is positioned within the opening; and inductively coupling the second conductive winding to the magnetic core to form a second inductor, wherein the second conductive winding is coupled such that the second shorting segment is positioned within the opening and overlaps the first shorting segment within the opening, and the first and second conductive windings are inductively coupled to the magnetic core such that at least one of the first plane and the second plane is oriented substantially perpendicular to the first direction and the first and second inductors are configurable to operate independently of one another.

11. A method in accordance with claim 10, wherein inductively coupling the first conductive winding and inductively coupling the second conductive winding comprises enclosing the first and second pairs of inductive segments within the magnetic core between the first side and the second side.

12. A method in accordance with claim 11, wherein the magnetic core includes a first piece and a second piece formed separately from the first piece, at least one of the first piece and the second piece having a plurality of channels defined therein, wherein enclosing the first and second pairs of inductive segments within the magnetic core comprises:

positioning the first pair of inductive segments within a first pair of the plurality the channels;

positioning the second pair of inductive segments within a second pair of the plurality of channels; and attaching the first piece of the magnetic core to the second piece of the magnetic core.

13. A method in accordance with claim 10, further comprising orienting the first shorting segment at an oblique angle with respect to the first plane.

14. An integrated inductor assembly comprising:

a magnetic core having a first side, an opposing second side, and an opening defined within said magnetic core, said opening extending into said magnetic core from at least one of said first side and said second side;

a first inductor comprising a first conductive winding inductively coupled to said magnetic core, said first conductive winding comprising a first pair of inductive segments and a first shorting segment interconnecting said first pair of inductive segments, wherein said first pair of inductive segments is disposed in a first plane and said first shorting segment is positioned within said opening and obliquely angled with respect to the first plane; and a second inductor comprising a second conductive winding inductively coupled to said magnetic core, said second conductive winding comprising a second pair of inductive segments and a second shorting segment interconnecting said second pair of inductive segments, wherein said second pair of inductive segments is disposed in a second plane and said second shorting segment is positioned within said opening, wherein said opening extends into said magnetic core in a direction substantially perpendicular to at least one of the first plane and the second plane, and said first and second inductors are configurable to operate independently of one another.

15. An integrated inductor assembly in accordance with claim 14, wherein said opening extends through said magnetic core from said first side to said second side.

16. An integrated inductor assembly in accordance with claim 14, wherein said first pair of inductive segments and said second pair of inductive segments are enclosed within said magnetic core between said first and second sides.

17. An integrated inductor assembly in accordance with claim 14, wherein said magnetic core has first and second opposing ends extending between said first side and said second side, said first conductive winding extending from said opening towards said first end, and said second conductive winding extending from said opening towards said second end.

18. An integrated inductor assembly in accordance with claim 14, further comprising a molding compound disposed within said opening, said first and second shorting segments enclosed within said molding compound.

19. An integrated inductor assembly in accordance with claim 1, wherein said magnetic core comprises a first piece and a second piece formed separately from and attached to said first piece, wherein said opening extends through said first piece and said second piece.

20. An integrated inductor assembly in accordance with claim 1, wherein said magnetic core includes a first section and a second section, said first conductive winding inductively coupled to said first section, said second conductive winding inductively coupled to said second section, said magnetic core further comprising a plurality of core bridges interconnecting said first section and said second section, the plurality of core bridges at least partially defining said opening.

* * * * *